United States Patent [19]

Pendola

[11] Patent Number: 4,491,301

[45] Date of Patent: Jan. 1, 1985

[54] TACKLES

[75] Inventor: Auguste Pendola, Paris, France

[73] Assignee: Etudes Constructions Appareils Levage, Garges les Gonesse, France

[21] Appl. No.: 474,513

[22] Filed: Mar. 11, 1983

[51] Int. Cl.[3] ..... B66D 1/38; B66D 1/56; B66D 1/58; B66D 3/08

[52] U.S. Cl. ..... 254/285; 254/273; 254/276; 254/337; 254/399; 254/404; 254/415; 254/902; 212/213

[58] Field of Search ..... 254/273, 276, 283, 284, 254/334, 335, 336, 337, 404, 412, 415, 416, 285, 310, 326, 292, 380, 399, 362; 310/88; 212/94, 95, 96, 213, 217; D8/360

[56] References Cited

U.S. PATENT DOCUMENTS

| | | | |
|---|---|---|---|
| D. 30,347 | 3/1899 | Williams | D8/360 |
| 1,060,676 | 5/1913 | Gilchrist | 254/404 X |
| 1,809,515 | 6/1931 | Hallenbeck | 212/95 |
| 2,247,795 | 7/1941 | Whitcomb et al. | 254/336 |
| 3,452,964 | 7/1969 | Bibeault | 254/380 X |
| 3,960,362 | 6/1976 | Griffiths et al. | 254/276 |
| 4,042,213 | 8/1977 | Schreyer et al. | 254/270 |
| 4,069,921 | 1/1978 | Raugulis et al. | 254/337 X |
| 4,205,246 | 5/1980 | Wise et al. | 310/88 X |
| 4,226,403 | 10/1980 | Schörling | 254/273 |

FOREIGN PATENT DOCUMENTS

| | | | |
|---|---|---|---|
| 682482 | 9/1939 | Fed. Rep. of Germany | 254/296 |
| 1120093 | 12/1961 | Fed. Rep. of Germany | 254/344 |
| 1152237 | 8/1963 | Fed. Rep. of Germany | 254/266 |
| 2312604 | 10/1974 | Fed. Rep. of Germany | 254/344 |
| 2700948 | 7/1978 | Fed. Rep. of Germany | 254/372 |
| 996125 | 12/1951 | France | 254/344 |

*Primary Examiner*—Stuart S. Levy
*Assistant Examiner*—Joseph J. Hail, III
*Attorney, Agent, or Firm*—Larson and Taylor

[57] ABSTRACT

Interposed between the driving shaft of the tackle and the hoisting hook of the tackle is a flat textile strap or a flat metal braid. The strap or braid is attached to the drum of a drum-pulley keyed on the driving shaft at the end of the strap or braid. The strap passes around the pulleys of a pulley-block comprising an upper block mounted on the frame of the tackle to pivot about a horizontal axis X-X, and a lower block suspended from the strap or braid and carrying the hook.

8 Claims, 15 Drawing Figures

TACKLES

FIELD OF THE INVENTION

The invention relates to a tackle which is provided with pulley-block means comprising an upper block carried by a frame and a lower block carrying a hoisting hook or the like and suspended below the upper block by means of a flexible line which passes around pulleys carried by the two blocks, at least one end of the line being attached to the drum of a drum-pulley driven by a rotary driving means.

Said rotary driving means may be of the manual, electric, pneumatic or hydraulic type. By "like means" (concerning the hoisting hook) is meant in particular an electromagnet capable of raising ferrous bodies, or a suction system capable of raising glass panes or the like.

BACKGROUND OF THE INVENTION

In the conventional tackles of the type defined hereinbefore, the flexible line is formed usually by a chain and the rotary driving means by a sheave or pulley whose groove is apertured in the shape of the links of the chain and around which the chain is wound only in a fraction of a turn. Beyond this sheave (at the end opposed to the hoisting hook), the chain hangs more or less freely and encumbers the space located below the tackle or is received in a large container which creates difficulties of placement and balancing of the tackle. In other tackles, the chain is replaced by a round cable but this arrangement results also in drawbacks well-known in the art such as the overall size of the drum-pulley usually in width (see U.S. Pat. No. 4,042,213), fragility, necessity to employ a cable guide, etc.

In tackles without pulley-block means, it has often been proposed to employ a flat flexible line (textile strap, steel band, metal braid). In this respect, there may be cited the German patent or patent application Nos. 682,482, 1,120,093, 1,152,237, 2,312,604, 2,700,948, the French patent 996,125 and the U.S. Pat. No. 3,452,964. In these known tackles, the flat flexible line is wound around the drum-pulley to a small height since it is possible to maintain the thickness of this flexible line, i.e. the thickness of each coil on the drum-pulley, to relatively low values because advantage can be taken of the width of this flexible line for increasing its tensile strength.

It is known that loads suspended from a tackle usually undergo a certain amount of lateral swinging. Up to the present time, this phenomenon has prevented replacing the cables or chains, in tackles having pulley-block means comprising an upper block and a lower block, by flat flexible lines, since said lateral swinging would subject these flat flexible lines to lateral forces which would tend to cause them to come out of the various pulleys guiding them.

SUMMARY OF THE INVENTION

An object of the invention is to arrange the tackles of the type defined in the introduction in such manner that they may be equipped with flat flexible lines without inconvenience as concerns the swinging of the suspended load.

For this purpose, the invention provides a tackle of the type defined hereinbefore, wherein the flexible line is flat, and the upper block is mounted on the frame in such manner as to be freely pivotable about a horizontal axis substantially tangent to the upper parts of the grooves of two successive pulleys, namely the pulley of the upper block which the flat flexible line reaches first in travelling from the drum-pulley and the pulley which succeeds this pulley in the direction toward the drum-pulley.

With this arrangement, the lateral swinging of the load is manifested by a pivoting of the upper block about said horizontal axis, this pivoting merely having for effect slightly to twist or untwist the flat flexible line without exerting on the latter lateral forces which would tend to cause it to come out of the various pulleys which guide it.

BRIEF DESCRIPTION OF THE DRAWING

The invention will now be described in more detail by means of the various embodiments shown diagrammatically in the accompanying drawings.

DETAILED DESCRIPTION OF THE PREFERRED EMBODIMENTS

Figure 1:
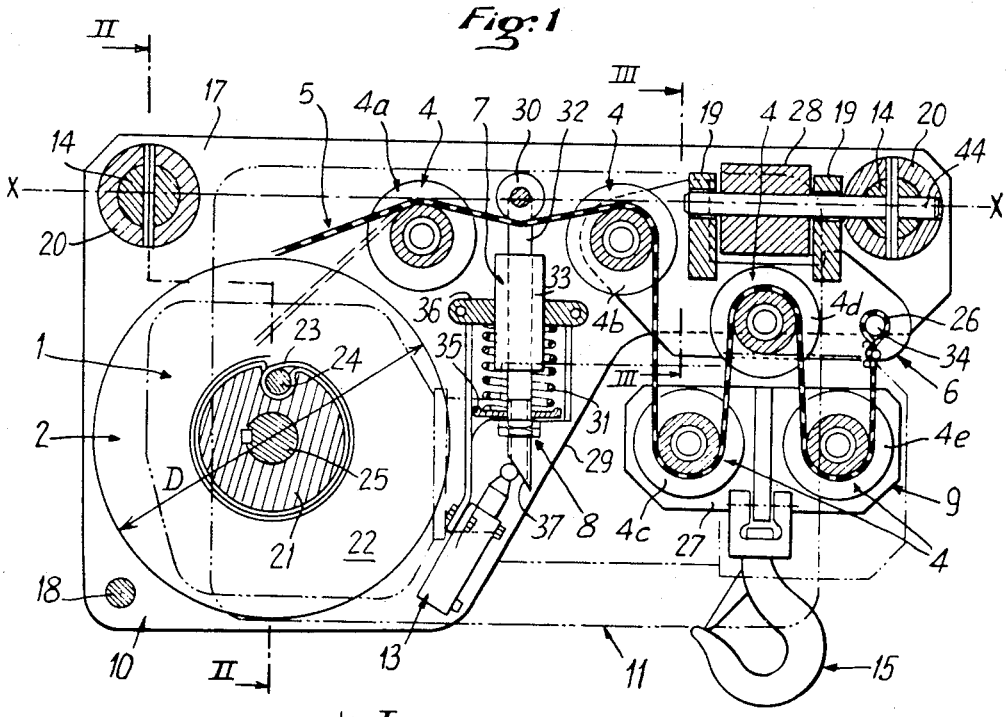
FIG. 1 of these drawings shows a tackle according to a first embodiment of the invention, in vertical longitudinal section taken along line I—I of FIG. 2.
Figure 2:
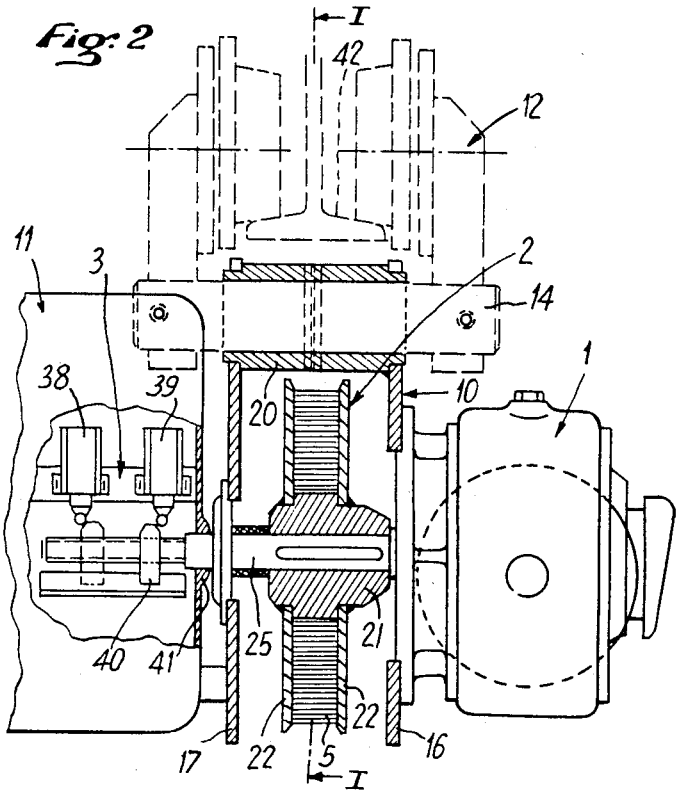
FIG. 2 is a sectional view of the tackle of FIG. 1 taken along offset vertical planes along the line II—II of FIG. 1.
Figure 3:
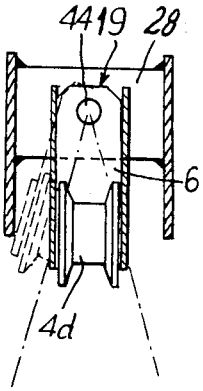
FIG. 3 shows a detail of the same tackle in vertical section taken along line III—III of FIG. 1.

The tackle shown in FIGS. 1 to 3 comprises a frame 10, formed by two vertical side walls 16, 17, which are rigidly assembled by means of, for example, horizontal rods, such as 18, a crossmember 28 and tubular spacer members 20.

The flexible line of the tackle, which line is flat, is formed by a flat textile strap (or a metal braid) 5 and the rotary driving means of the tackle is formed by a drum-pulley 2 comprising a drum 21 and two cheeks 22 and disposed between the two side walls 16 and 17. One of the ends 23 of the strap 5 is attached, for example, by means of a key 24, to the drum 21 of the drum-pulley 2 whose cheeks 22 have sufficient diameter D to contain the strap 5 wound to the maximum extent on the drum 21, as can be seen in section in FIG. 2 (the strap 5 extending then from the drum-pulley 2 in the manner shown in full lines in FIG. 1).

The drum-pulley 2 is keyed on a shaft 25 which constitutes the output and suitably elongated shaft (low-speed shaft) of an electric motor-speed reducer unit 1. As can be seen in particular in FIG. 2, this unit, which is of the incorporated brake type, is mounted on the outer side of the side wall 16 and its shaft 25 extends through the two side walls 16 and 17 and beyond the side wall 17.

In leaving the drum-pulley 2, the strap 5 passes around a plurality of pulleys 4 and its end, 26, opposed to the end 23, is hooked to the frame 10 in the manner described hereinafter in such manner that the strap 5 can support a pulley-block 9 having one, two or three strap portions, a hoisting hook 15 being mounted on this pulley-block 9. The latter comprises an upper block 6 carried by the frame 10 and a lower block 27 suspended below the upper block 6 by means of the strap 5. In the embodiment shown in FIG. 1, the strap 5 passes in succession around a first pulley 4*a* whose spindle is carried directly by the frame 10, around a second pulley 4*b* mounted in the upper block 6, around a third pulley 4*c* mounted in the lower block 27, around a fourth pulley 4*d* mounted in the upper block 6 in any suitable manner, for example by means of a transverse pin 34. It will be understood that such a pulley-block means could be replaced by a pulley-block means of any other equivalent type, examples of which will be described hereinafter, with reference to FIGS. 4 to 9.

According to the invention, the upper block 6 is mounted on the frame 10 in such manner as to be freely pivotable about a horizontal axis X—X substantially tangent to the upper part of the groove of the pulley 4*b* of the pulleys 4 of the upper block 6 that the strap 5 reaches first of all in travelling toward the drum-pulley 2 and tangent to the upper part of the groove of the pulley 4*a* which succeeds the pulley 4*b* in the direction toward the drum-pulley 2 (see FIG. 1). This horizontal axis X—X is embodied by a pivot pin 44 which extends through aligned apertures formed in the cross-members 19 of the upper block 6 and in the cross-member 28 and in one of the tubular spacer members 20 of the frame 10. The latter, which is formed by the two approximately rectangular side walls 16 and 17, is provided with a notch 29 in its lower part and below the upper block 6. The side walls 16, 17 carry therebetween, substantially at the same height, on one side, the drum-pulley 2 and, on the other side, the pulley-block means 9. This facilitates the lateral movements of the lower block 27 and enables the hook 15 to be raised to a very high position relative to the frame 10.

The tackle preferably comprises, by way of a load limiter, a device 7 which is capable of reacting when the tension of at least one strap portion, in the present instance the portion between the pulleys 4*a* and 4*b*, exceeds a pre-determined and preferably adjustable threshold value. In the embodiment shown in FIG. 1, the load limiting device 7 comprises a roller 30 which bears against the upper side of the belt 5 between the considered pulleys 4*a* and 4*b*, this roller 30 being guided in a vertical (or approximately vertical) path and biased downwardly by a spring 31. For this purpose, the horizontal spindle of the roller 30 is carried by a rod 32 guided in a vertical sleeve 33 and screw-threaded, at the end opposed to the roller 30, so as to receive a nut and a lock nut 8. The latter act as a support for a cup 35, the spring 31 being a compression spring which acts on this cup 35 with a reaction on the support 36 of the sleeve 33. The rod 32 acts by means of its free end portion in the shape of a ramp 37 on an end-of-travel electric switch 13. This switch 13 is inserted in the supply circuit of the motor-speed reducer 1 so as to stop the latter when the load applied on the hook 15 exceeds a given threshold value, i.e. when the rod 32 travels upwardly a given height relative to the frame 10. This threshold value may be adjusted by means of the nut and its lock nut 8 which determine the extent to which the spring 31 is stressed.

The supply circuit of the motor-speed reducer unit 1 is completed by end-of-travel switches 38 and 39 which cooperate with a nut 40 which is mounted on the screwthreaded free end portion of the shaft 25 of the motor-speed reducer unit 1 and respectively determine the upward and downward limits of the displacement of the hook 15. These end-of-travel switches 38 and 39 are mounted on a bar 3 inside an electric cabinet 11 mounted on the frame 10. This cabinet 11 may be rendered fluid-tight by means of a sealing element 41 where the shaft 25 extends therethrough.

It is sufficient to employ a motor-speed reducer unit 1 with an incorporated brake of the non-deflagrating type and to place in a non-deflagrating cabinet 11 the switches 13, 38, 39 and other electric components of the supply circuit of the motor-speed reducer unit 1, to provide a tackle having a non-deflagrating and non-sparking character.

The tackle according to the invention may be of the type which is placed on, hooked to, or suspended from a trolley. The latter arrangement has been diagrammatically represented in dotted lines in FIG. 2 where a trolley 12 rolls along a monorail 42, the tackle being suspended from this trolley by means of suspension pins 14 which extend through the tubular spacer members 20.

In this way there is provided a tackle whose strap 5 is maintained taut between its ends 23 and 26 by the winding thereof in successive coiled layers on the drum-pulley 2, the limits of the winding being shown diagrammatically respectively in dotted lines and in full lines in FIG. 1 by the end positions of the strap 5 as it leaves this drum-pulley 2.

When the load suspended from the hook 15 tends to swing transversely, this results in a swinging of the lower block 27, facilitated by the notch 29, and consequently in a pivoting of the upper block 6 about the horizontal axis X—X and in a slight twisting of the part of the strap 5 between the pulleys 4*a* and 4*b*.

When the load suspended from the hook 15 exceeds a safety threshold value, the tension of the portion of the strap 5 between the pulleys 4*a* and 4*b* has, in the region of the roller 30, a sufficient vertical component to overcome the action of the spring 31. Consequently, the roller 30 and the rod 32 rise and the end of the latter in the shape of a ramp 37 leaves the electric switch 13 and this cuts off the supply to the motor-speed reducer unit 1 as concerns the raising of the load. It is sufficient to reduce the load to enable the spring 31 to lower the rod 32 until its end in the shape of a ramp 37 resumes contact with the switch 13 and closes the supply circuit of the motor-speed reducer unit 1.

Figure 4:
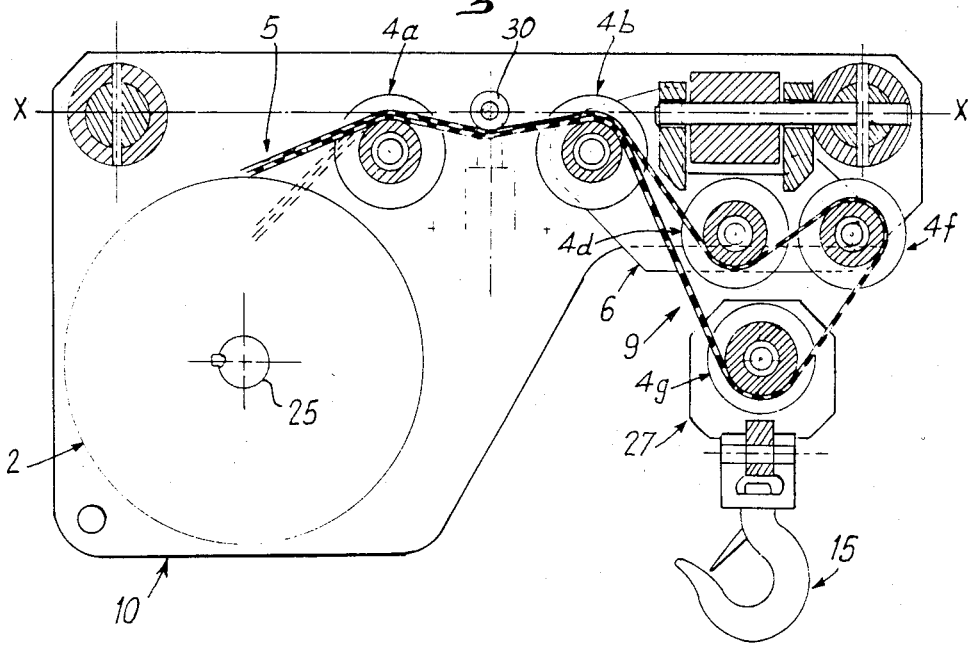
FIGS. 4 to 9 show, as FIG. 1, tackles according to many different embodiments of the invention.

The embodiment of FIG. 4 differs from that of FIG. 1 in that the two ends (designated by reference numerals 23 and 26 in FIG. 1) of the strap 5 are attached to the drum of the drum-pulley 2 by forming a loop whose two portions are in overlapping relation on this drum and on the pulleys 4*a* and 4*b* and then separate into an upper portion and a lower portion. In leaving the pulley 4*b*, the upper portion passes around two pulleys of the upper block 6, i.e. around a pulley 4*d* identical to that of FIG. 1 and around a pulley 4*f* whose spindle 43 has the same position as the pin 34 of FIG. 1. In leaving the pulley 4*b*, the lower portion extends directly to the single pulley 4*g* of the lower block 27 where it is joined by the upper portion of the strap. In reaching the pulley 4*b*, the upper and lower portions make an angle which is wide enough to ensure that they do not twist between the blocks 6 and 27. Note that the pulley 4g rotates only if the upper and lower portions of the strap undergo a relative elongation.

Figure 5:
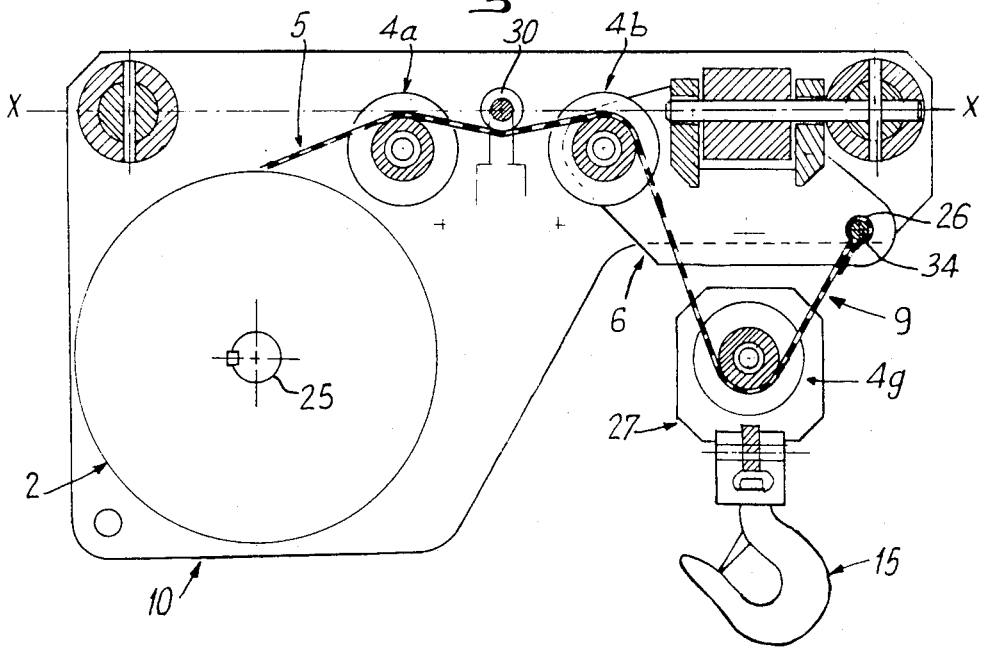

The embodiment of FIG. 5 differs from that of FIG. 1 by the elimination of the pulley 4d on the upper block 6 and by the replacement of two pulleys 4c and 4e by a single pulley 4g on the lower block 27. The strap 5 therefore extends from the pulley 4b to the pulley 4g before reaching the attachment pin 34 on the upper block 27. As in the case of FIG. 4, the two portions of the strap 5 which meet at the pulley 4g make an angle wide enough to ensure that they do not twist between the blocks 6 and 27.

Figure 6:
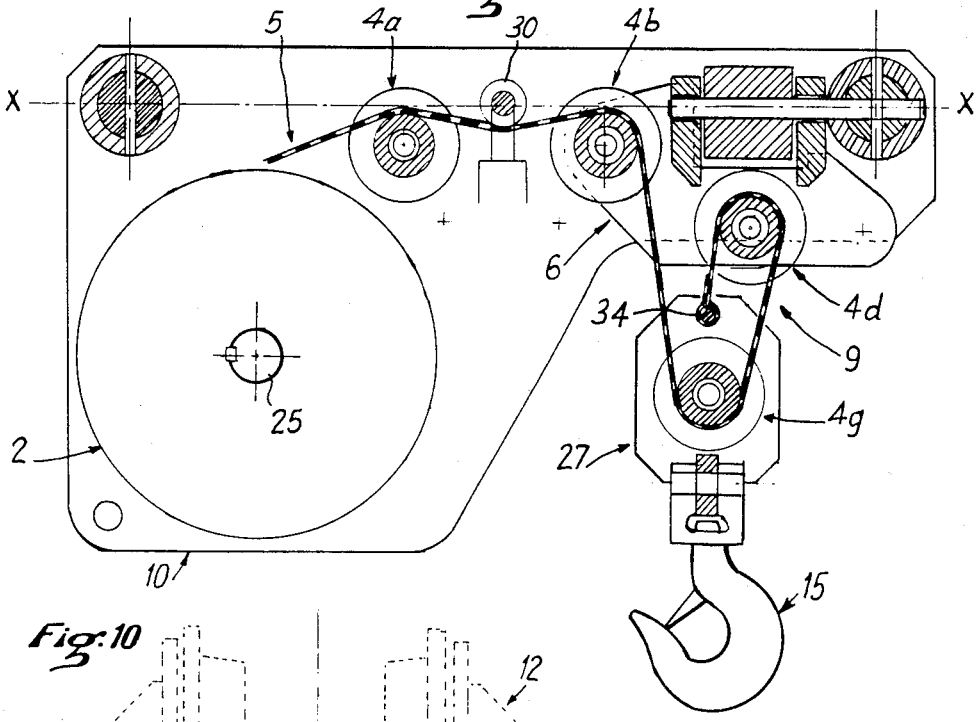

The embodiment of FIG. 6 differs from that of FIG. 1 by the replacement of the two pulleys 4c and 4e by a single pulley 4g on the lower block 27 and by the attachment of the end 26 or the strap 5, not to the upper block 6 but to the lower block 27, by means of for example the pin 34. The strap therefore passes in succession around the pulley 4b of the upper block 6, around the single pulley 4g of the lower block 27, around the pulley 4d of the upper block 6 before being attached to the lower block 27 by its end 26.

Figure 7:
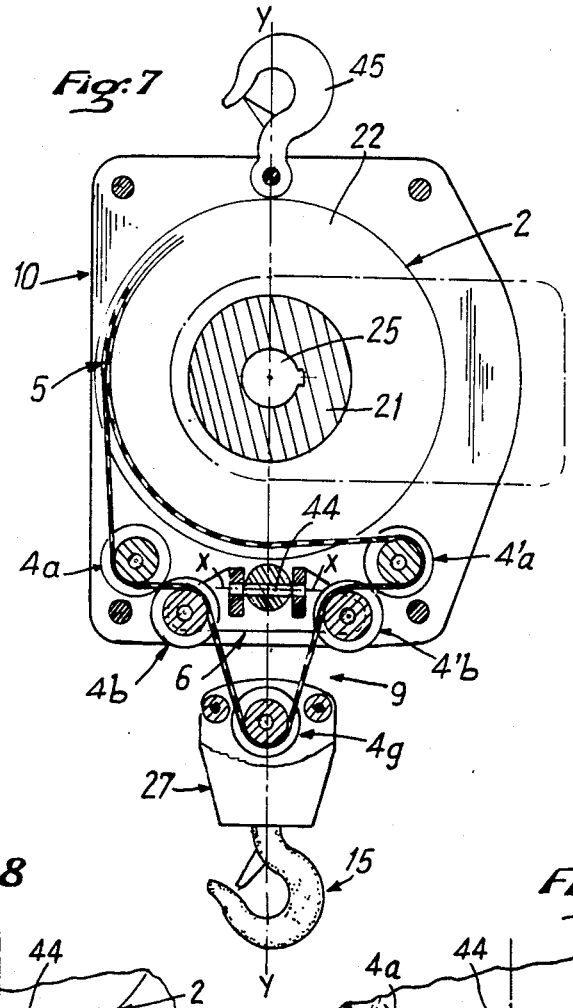
Figure 8:
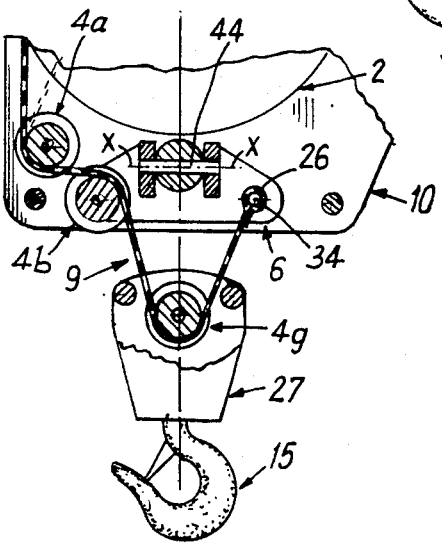
Figure 9:
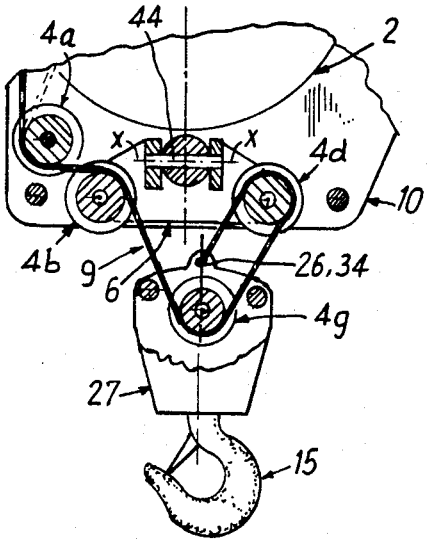

FIGS. 7 to 9 illustrate the aforementioned modification in which the tackle is hooked by means of a hook 45 which is fixed to the frame 10 and is shown only in FIG. 7 since the FIGS. 8 and 9 are broken away in their upper part. In this case, the pulley-block means 9 is disposed, not at the same height as the drum-pulley 2 as in the embodiments of FIGS. 1, 4, 5, and 6, but below the drum-pulley. Therefore, the pin 44 embodying the axis X—X is placed in vertical alignment with the shaft 25 as close as possible to the lower edge of the cheeks 22 of the drum-pulley 2.

In the embodiment shown in FIG. 7, the two ends of the strap 5 are attached to the drum 21, as in the embodiment of FIG. 4, and forms two strap portions which are here in overlapping relation solely on the drum 21. The left strap portion (as viewed in the drawing) passes around pulleys 4a and 4b which are arranged as in the preceding embodiments and the right strap portion passes around pulleys 4'a and 4'b which are respectively similar to these pulleys 4a and 4b and symmetrical with the latter relative to a vertical plane Y—Y passing through the axis of the suspension hook 45 and through the axis of the shaft 25. The two strap portions meet at the single pulley 4g of the lower block 27 and make an angle which is wide enough to prevent the strap 5 from twisting.

The embodiment of FIG. 8 is identical, as concerns its upper part, to the embodiment of FIG. 7 and, as concerns its lower part, to the embodiment of FIG. 5.

The embodiment of FIG. 9 is identical, as concerns its upper part, to the embodiment of FIG. 7 and, as concerns its lower part, to the embodiment of FIG. 6.

Figure 10:
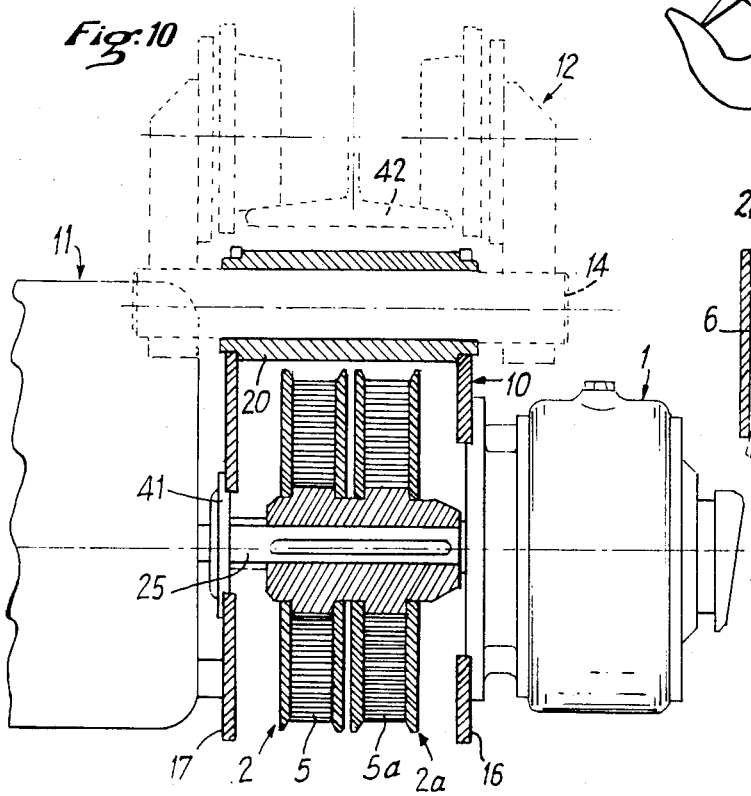
FIGS. 10 and 11 show, in views respectively similar to those of FIGS. 2 and 3, tackles employing straps and mounted in parallel.
Figure 11:
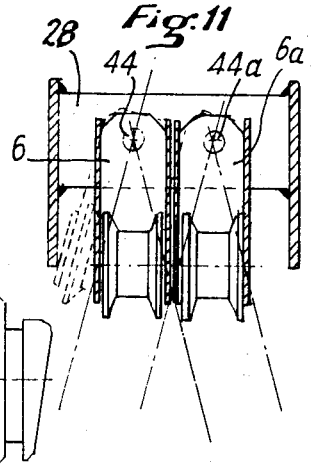

In the embodiment of FIGS. 1 to 3, as moreover in those of FIGS. 4 to 9, it has been assumed that the tackle according to the invention had only one strap 5 passing around a single drum-pulley 2 and a single set of pulleys 4. In fact, this tackle could comprise in parallel relation at least two of such straps 5 wound respectively around as many drum-pulleys keyed on the same shaft 25. By way of example, FIGS. 10 and 11 illustrate, in views similar to those of FIGS. 1 and 3, the case of a tackle comprising two straps 5 and 5a wound respectively around two drum-pulleys 2 and 2a and with which straps are associated two upper blocks 6 and 6a mounted on individual pins 44 and 44a.

Figure 12:
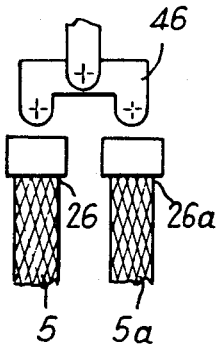
FIG. 12 shows a balancing device for the tackle having two straps of FIGS. 10 and 11.
Figure 13:
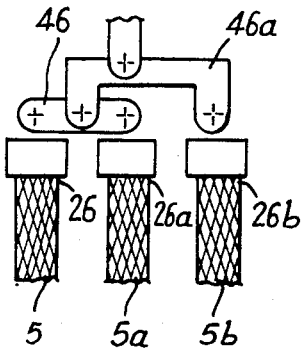
FIGS. 13 and 14 show balancing devices similar to that of FIG. 12 but for tackles having three straps and four straps, respectively.
Figure 14:
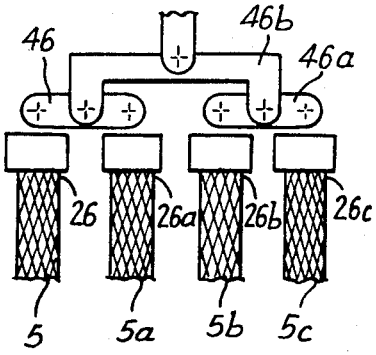

In order to balance the two straps 5 and 5a, it is of interest to attach their ends 26 and 26a by means of a compensating rocking lever such as 46 (FIG. 12). In the case where the tackle would have three straps 5, 5a, 5b in parallel relation, their ends 26, 26a and 26b could likewise be attached by means of a system having two rocking levers such as 46 and 46a (FIG. 13). In the case where the tackle would have four straps 5, 5a, 5b and 5c in parallel relation, their ends 26, 26a, 26b and 26c could be attached by means of a system having three rocking levers such as 46, 46a and 46b (FIG. 14). With this rocking lever system, the loads are equally distributed among the straps, even if the lengths of the straps are not exactly the same.

Figure 15:
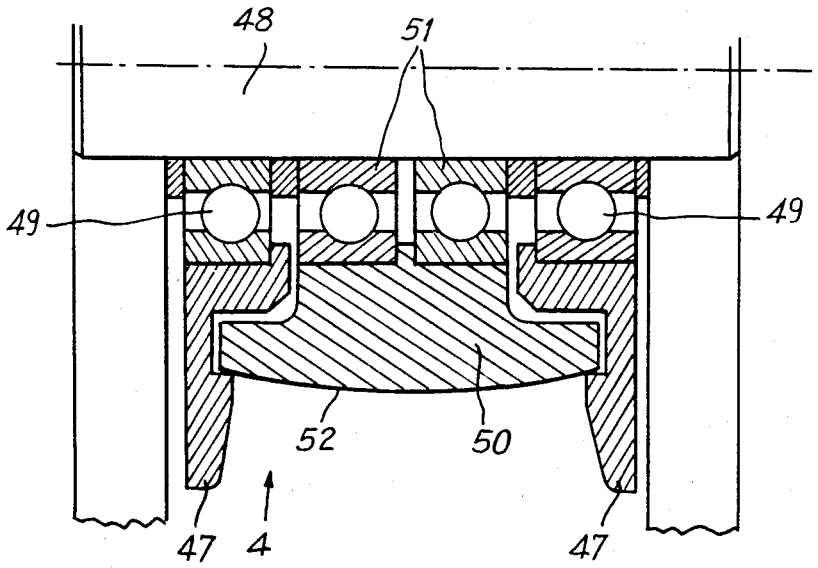
FIG. 15 is an axial half-sectional view of a modification of the pulleys.

As illustrated in axial half-section in FIG. 15, in order to avoid wear of the strap 5 on its edges, it is of interest to arrange the pulleys 4 in such manner that their cheeks 47 are freely mounted on the shaft 48 of these pulleys, by means of for example individual rolling bearings 49 independently of the body 50 of this pulley 4 which is mounted on the shaft 48 by for example rolling bearings 51. Further, for the same purpose, it is of interest to give the strap-receiving on outer surface 52 of the body 50 a crowned shape.

Whatever embodiment is adopted, a tackle is obtained which has in particular the following advantages:

low cost;

small overall size;

elimination of the conventional cable guides;

no offsetting of the hook 15, between the lower position and upper position of its travel, the hoisting and the lowering of this hook 15 therefore occurring always on the same perfectly vertical axis;

when the tackle is employed as the non-deflagrating or non-sparkling type, there is no risk of sparks between the flexible line 5, when it is formed by a textile strap, and the metal parts of the tackle (drum-pulley 2, pulleys 4, etc.);

very small "lost height" (distance between the top of the tackle and the hook 15 in the upper position of the latter) in the embodiments of FIGS. 1 to 6;

possibility of employing the same elements for constructing a tackle hoisting by means of a pulley-block having a plurality of strap portions according to the invention and a tackle hoisting directly (without a pulley-block);

decrease in the speed of the hook 15 from its upper position to its lower position and vice versa, owing to the gradual variation in the winding diameter on the drum-pulley 2.

It will be understood that the scope of the invention is not intended to be limited to the illustrated embodiments but encompasses all modifications. In particular, it would be possible to mount for pivotal motion about the axis X—X not the upper block 6 alone but the whole of the frame 10 of the tackle by means of, for example, upper spacer members 20, so as to permit a good winding of the strap 5 around the drum-pulley 2 and also, in the more general case, around the pulleys 4.

Having now described my invention what I claim as new and desire to secure by Letters Patent is:

1. A tackle comprising:

a frame;

a drum pulley including a drum;

rotary driving means for driving said drum pulley;

a pulley system including an upper pulley block attached to said frame, a lower pulley block, and at least one upper pulley mounted on said upper pulley block and at least one lower pulley mounted to said lower pulley block;

a load carrier attached to said lower pulley block;

a flat and flexible line which suspends said lower pulley block from said upper pulley block, said line passing around said pulley system and being attached at one end to said drum and at the other end to one of said drum, said upper pulley block, and said lower pulley block;

a mounting means for mounting said upper pulley block to said frame such that said upper pulley block is freely pivotable about a horizontal axis and such that the upper portion of the line receiving groove of said at least one upper pulley is substantially tangent to the horizontal pivot axis of said mounting means; and wherein said pulley system further includes a frame pulley which is mounted to said frame between said drum and said at least one upper pulley, said frame pulley having a line receiving groove portion which is substantially tangent to the horizontal pivot axis of said mounting means.

2. A tackle as claimed in claim 1 wherein said frame includes two opposed side walls having a notch cut out at one lower corner, said sidewalls carrying said upper pulley block therebetween above said notch at the upper corner and said drum pulley therebetween at the other end; and said notch being sized to receive said lower pulley block such that said lower pulley block is approximately horizontally opposite said drum pulley.

3. A tackle as claimed in claim 1 and further including a frame mounting means for mounting said frame to a support so that said frame is freely pivotable about a horizontal axis.

4. A tackle as claimed in claim 1 wherein said frame carries a suspension hook in a position above said drum pulley and said upper pulley block in a position below said drum pulley.

5. A tackle as claimed in claim 1 and further including a second flat flexible line and a second drum pulley, said second drum pulley also being driven by said rotary driving means.

6. A tackle as claimed in claim 5 and further including a rocking lever compensating system for attaching respective other ends of said flexible lines.

7. A tackle as claimed in claim 1 wherein said pulleys have cheeks and a body, said body having an outer surface which is crowned; and a mounting means for mounting said cheeks for independent rotation relative to said body and each other.

8. A tackle as claimed in claim 1 wherein said driving means is a motor-speed reducer unit having an output shaft to which said drum pulley is keyed; said unit being non-deflagrating, having an electric supply connected thereto, and having electric components disposed in a non-deflagrating cabinet.

* * * * *